US005785308A

United States Patent [19]

Flores et al.

[11] Patent Number: 5,785,308

[45] Date of Patent: Jul. 28, 1998

[54] MEDIA PASS THROUGH CONFIGURATION FOR PRINTERS

[75] Inventors: Armando Villarreal Flores; Michael Earl Kennedy, both of Lexington, Ky.

[73] Assignee: Lexmark International, Inc., Lexington, Ky.

[21] Appl. No.: 563,695

[22] Filed: Nov. 28, 1995

[51] Int. Cl.[6] ..... B65H 3/44

[52] U.S. Cl. ..... 271/9.11; 271/9.13; 271/162; 271/164

[58] Field of Search ..... 271/9.11, 9.13, 271/162, 164, 273

[56] References Cited

U.S. PATENT DOCUMENTS

| | | | |
|---|---|---|---|
| 4,531,823 | 7/1985 | Deguchi | 355/3 |
| 4,941,002 | 7/1990 | Maruyama | 346/160 |
| 4,958,822 | 9/1990 | Rutishauser | 271/9 |
| 4,966,356 | 10/1990 | Ohyabu et al. | 371/9 |
| 5,052,670 | 10/1991 | Makiura et al. | 271/9 |
| 5,155,537 | 10/1992 | Komatsu et al. | 355/309 |
| 5,263,707 | 11/1993 | Kuzumi | 271/293 |
| 5,375,826 | 12/1994 | Flores | 271/10 |
| 5,413,409 | 5/1995 | Arai | 271/162 X |

FOREIGN PATENT DOCUMENTS

| | | | |
|---|---|---|---|
| 0370484 | 5/1990 | European Pat. Off. | 271/9.11 |
| 60-197541 | 7/1985 | Japan | B65H 3/44 |
| 3267226 | 11/1991 | Japan | 271/9.11 |
| 6107345 | 4/1994 | Japan | 271/9.13 |
| 2 260 760 | 4/1993 | United Kingdom | B65H 5/00 |

*Primary Examiner*—David H. Bollinger
*Attorney, Agent, or Firm*—John A. Brady

[57] ABSTRACT

A media pass through configuration for printers in which media is fed from superimposed and removable media holders, such as trays, through a media path to a print engine. A rack disposed in either the frame of the printer or other modular and stackable media option, is dimensioned for receiving at least one media carrying, removable tray disposed beneath the print engine. A door, hinge and latch combination, the hinge connected intermediate the door and either the frame of the printer or the frame of the modular option so that the door opens in a plane swingable substantially about one longitudinally extending edge of the media path to the print engine, and outwardly and away from the front of the tray. The latch is positioned remotely from the hinge for moveably attaching the door to the printer in a position confronting the tray when the door is in a closed or first position, and open for facilitating tray removal when the door is in an open or second position. A media guide is mounted on the interior of the door for guiding different media in front of the tray, into the media guide path and to the print engine. In one instance, the media guide includes a chute having converging interior walls therein for urging media therethrough in a predetermined path. In another configuration, the media guide includes a portion of the chute on the door and a second portion of the chute formed on the portion of the tray confronting the interior of the door. In either of the forgoing, the doors may be individually opened to allow entrance to the confronting media tray or ganged to permit simultaneous access to all the trays and media being fed to the print engine.

12 Claims, 8 Drawing Sheets

MEDIA PASS THROUGH CONFIGURATION FOR PRINTERS

BACKGROUND OF THE INVENTION

1. Field of the Invention

The present invention relates to media (paper and the like) pass through configurations for a printer and more particularly relates to configurations which permit easy passage for media to bypass other options, if necessary, while also providing enhanced user access to media storage for media replacement and for clearing incidental media jams.

2. Description of Related Art

Use of vertically stacked input options in a printing system (e.g. multiple trays of different size paper) creates a need to transport media from distant trays through or around other options to reach the printer engine. Specific requirements for this "pass-through" or "pass-around" capability are different depending on the media path configuration selected for the printer.

"Pass-through" is not a unique capability. Existing printers "pass" paper through their units. However, in some instances, printers have utilized a "rear input" paper path wherein paper enters the printer from the rear of the print engine. In these configurations, input options "pass-through" input media up through the rear of the option "base", beyond the paper tray. However, other printers use a "front input" path, which requires input options to feed media through the front of their devices. Because media (paper) trays must be removed to be loaded, a different approach is required to attain necessary "pass-through" or "pass-around" capabilities.

Other manufacturers utilize "pass-through" capabilities. For example, in U.S. Pat. No. 4,958,822 issued on Sep. 25, 1990 to Rutishauser, media (paper) from a more-distant tray, is passed through specifically designed "pass-through" slots that are molded into the media trays above it. In another similar design shown in U.S. Pat. No. 4,966,356 issued on Oct. 30, 1990, to Ohyabu et al., cassettes of cut sheets are stacked one above the other. Each cassette has a common sheet passage passing through the cassette from the bottom to top. The passages are aligned to form a common sheet feed passage which passes through the stack of the cassettes from bottom to top.

In FIG. 3, a fragmentary side elevational view of the prior art such as illustrated in the above identified patents, is shown. As illustrated, a pair of cassettes 1, 2, carrying stacks of media such as cut sheet paper 3, 4 of different sizes, e.g. letter and legal respectively, are shown in superimposed, overlapping relation. As is conventional, the cassettes are trays mounted for sliding ingress and egress with respect to a printer on racks *9a*, *9b* which may be connected to or form part of the frame (not shown) of the printer. The paper in each of the cassettes is fed upwardly between the nip of pinch rolls *5a*, *5b*, *6a*, *6b* respectively as by sheet feeder mechanism (not shown) but such as illustrated in U.S. Pat. No. 5,375,826, issued on Dec. 27, 1994 to the assignee of the present invention. Each of the cassettes 1, 2 has a media guide passage 7, 8 therethrough respectively, which passages are aligned when the cassettes are positioned in the printer to permit guided transition of paper from the lower cassette 2 through the upper cassette 1 to the print engine of the printer. With this type of structure, the cassettes may be stacked. The cassettes must be removable, preferably from the front, so that they can be reloaded with new media by the operator-user. Media from an "underneath" tray is fed through the guide passages located in each of the above trays. In this configuration, the slot is molded as an integral part of the tray structure. When the tray is pulled out for reloading, the pass-through slot is also removed (since it is part of the tray itself). However, when a paper jam occurs, or the cassettes have to be removed for refilling, then paper must be removed from the guide passages 7 and 8 and the pinch rollers *5a*, *5b*, *6a*, *6b* usually by tearing.

In yet another configuration, as shown in U.S. Pat. No. 5,155,537 issued on Oct. 13, 1992, the pass through passage is formed as part of the front cover, which is lowered, much like an oven door, to permit entrance to and egress from of the media loaded tray or cassette. While there are advantages to this type of structure, the lowering of the door places the guide for the media, from the lower cassette or tray, in the path of the cassette or tray as it is removed from the printer. Unless the operator is careful, the tray will either damage the guides on the door, or the cassette, or both. Moreover, if there is a paper jam above or below the door, excessive tension may be placed on the paper as the door is opened which can likewise damage the machine, parts of the paper path etc. or can make the jam difficult to remove.

SUMMARY OF THE INVENTION

In view of the above, it is a principal object of the present invention to provide a media pass through configuration which avoids the inherent difficulties of the prior art.

Another object of the present invention is to provide a media pass through configuration in which guidance of media from underlying media holding trays, is facilitated while permitting ease of loading and unloading media trays and clearing incidental media jams in the media feed side of the print engine in a printer.

The invention creates two related configurations for passing media in front of a printer media input module or "tray" from which media is fed from superimposed and removable media holders or trays through a media path to a print engine. A rack in the frame of the printer is dimensioned for receiving at least one media carrying, removable tray disposed beneath the print engine. A door, hinge and latch combination is provided, the hinge connected intermediate the door and frame of the printer so that the door opens in a plane swingable substantially about one longitudinally extending edge of the media path to the print engine, and outwardly and away from the front of the tray. The latch is positioned remotely from the hinge for selectively attaching the door to the printer in a position confronting the tray when the door is in a closed or first position, and open or in a second position for facilitating (unimpeded) tray removal. Media guide means are mounted on the interior of the door for guiding different media in front of the tray, into the media guide path and to the print engine. In one instance, the media guide means includes a chute having converging interior walls therein for urging media therethrough in a predetermined path. In another configuration, the media guide means includes a portion of the chute on the door and a second portion of the chute formed on the portion of the tray confronting the interior of the door. In either of the forgoing, the doors may be individually opened to allow entrance to the confronting media tray or ganged to permit simultaneous access to all the trays and media being fed to the print engine.

Other objects, features and advantages, and a more complete understanding of the present invention will appear more fully from the following description and claims taken in connection with the accompanying drawings in which:

DESCRIPTION OF THE ILLUSTRATIVE EMBODIMENTS

Figure 1:
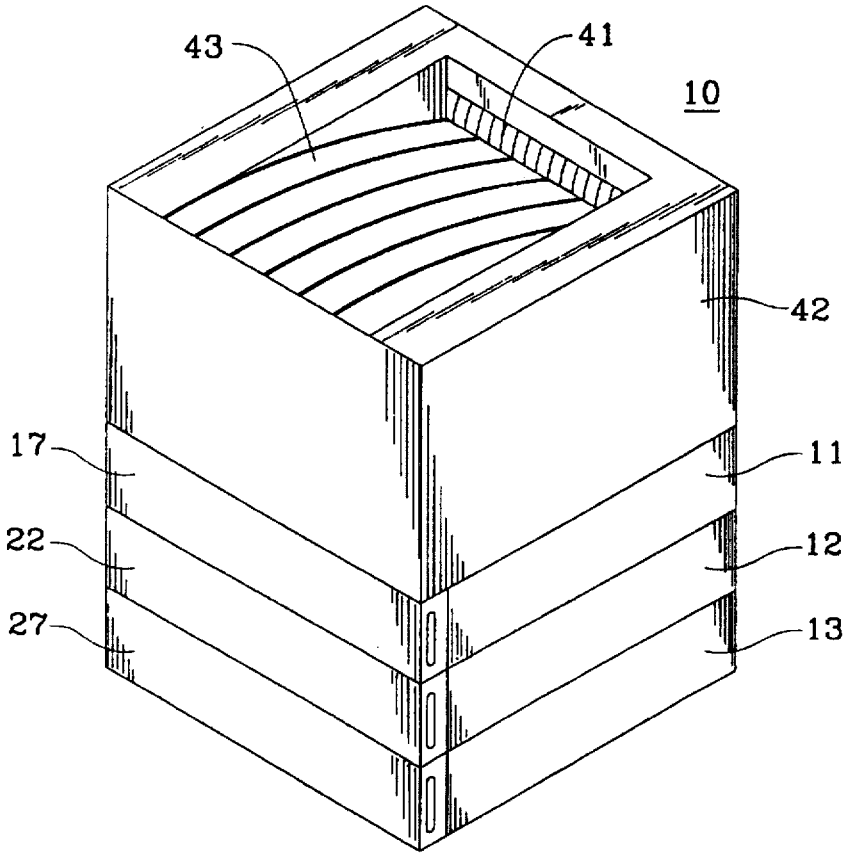
FIG. 1 is a front elevational perspective view of a typical quality printer employing multiple, modular, media carrying trays for feeding media of different sizes to a print engine within the printer.
Figure 2:
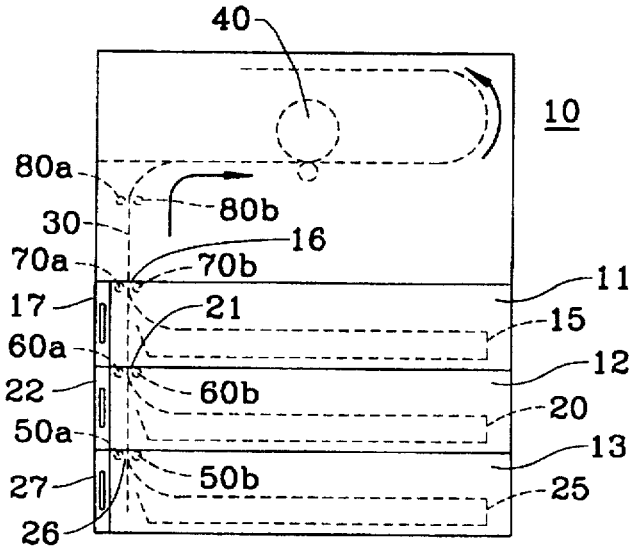
FIG. 2 is a fragmentary, schematic, side elevational view of the printer of FIG. 1 and illustrating the intended path of media through the printer.
Figure 3:
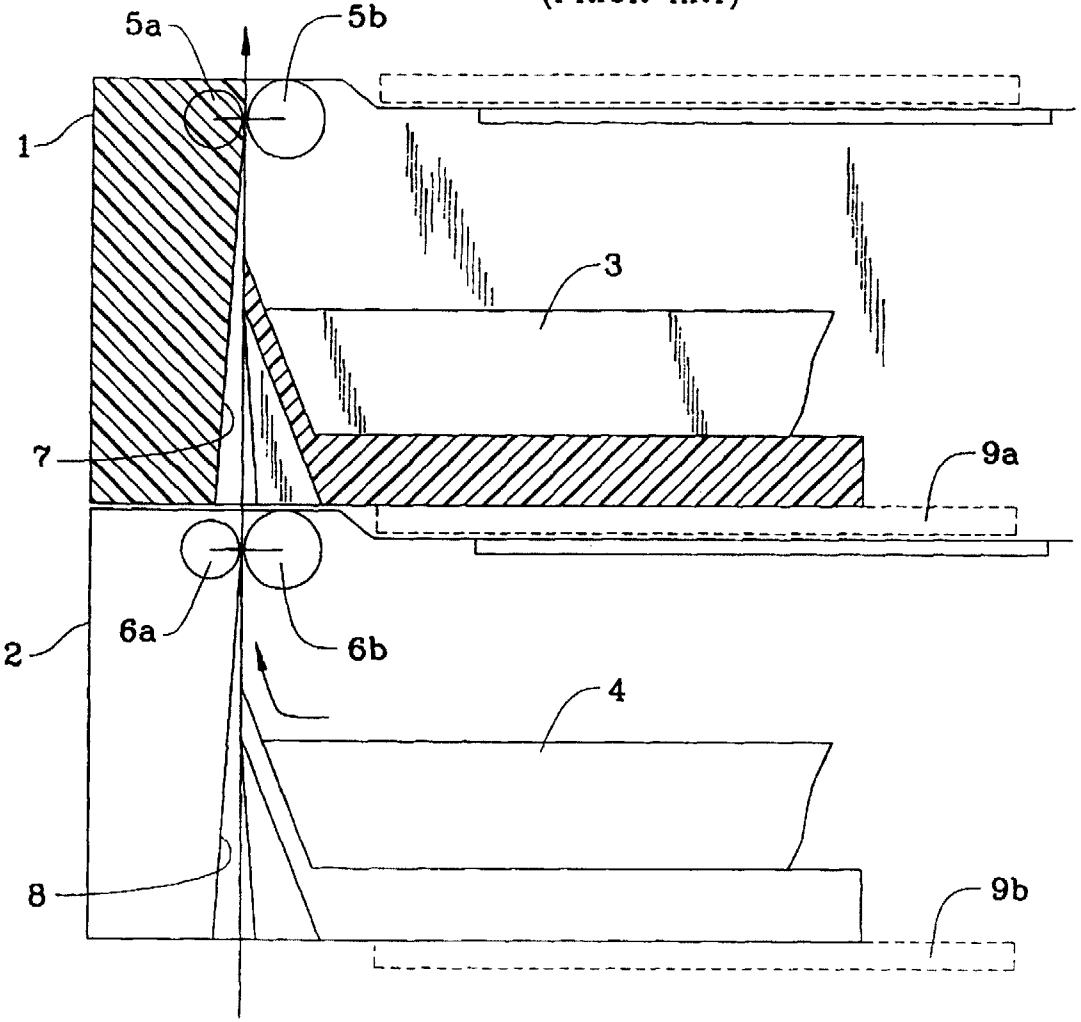
FIG. 3 (PRIOR ART)
FIG. 3 is an enlarged fragmentary sectional view of typical stacked construction, modular, prior art media cassettes or trays for printers and in which the media passes through a passage which is integral with the tray or cassette.

Referring now to the drawings, and especially FIG. 1 thereof, a schematic perspective view of a printer 10 incorporating the novel media pass through configuration of the present invention, is illustrated therein. The printer 10 may be connected directly to, for example, a computer (not shown) or connected to a network and act as the printer for multiple computers, either operating locally or remotely. As shown in FIG. 2, the printer 10 contains multiple media carrying trays 15, 20 and 25, each of the trays being loaded with media such as cut sheet paper, and each capable of carrying varying media sizes (e.g. letter, legal, A4 etc.). The trays may be mounted integrally with the printer 10 or may be contained in separate, stackable, modular, media feed options, such as the modules 11, 12 and 13 illustrated in FIGS. 1 & 2. Also illustrated in FIG. 2 in dotted lines is the media path 30. As shall be described in greater detail hereinafter, media stored in the media input modules or trays 15, 20 and 25 must enter the media path 30 to feed that media into the print engine 40, wherein print is applied to media as it is presented to the print engine 40. Thereafter, the media progresses through a slot 41 in the printer casing 42 and is deposited onto a media receiving tray 43 located on the upper portion of the printer 10.

As illustrated in U.S. Pat. No. 5,375,826, issued on Dec. 27, 1994 to Flores, A. V., one of the inventors of the present invention, owned by the assignee of the present invention and incorporated by reference herein, when a piece of media (for example, a cut sheet of paper) is to be fed from a specific tray, the media is "picked" from the tray. (For simplicity, the mechanism needed to pick media from the tray and to feed it to the drive rollers is not shown herein but is illustrated in the above identified patent). As shown schematically in FIG. 2, the sheets are fed into appropriate "pass-through" slots 26, 21 and 16 (in the media guide path 30) by a series of drive or pinch roller pairs 50*a* & 50*b*, 60*a* and 60*b*, 70*a* and 70*b* and 80*a* and 80*b*. As shown in FIG. 2, the pinch rolls are generally mounted interiorly of the printer and driven in a conventional manner to propel the media upward through the appropriate pass-through slots to the print engine 40.

Figure 4:
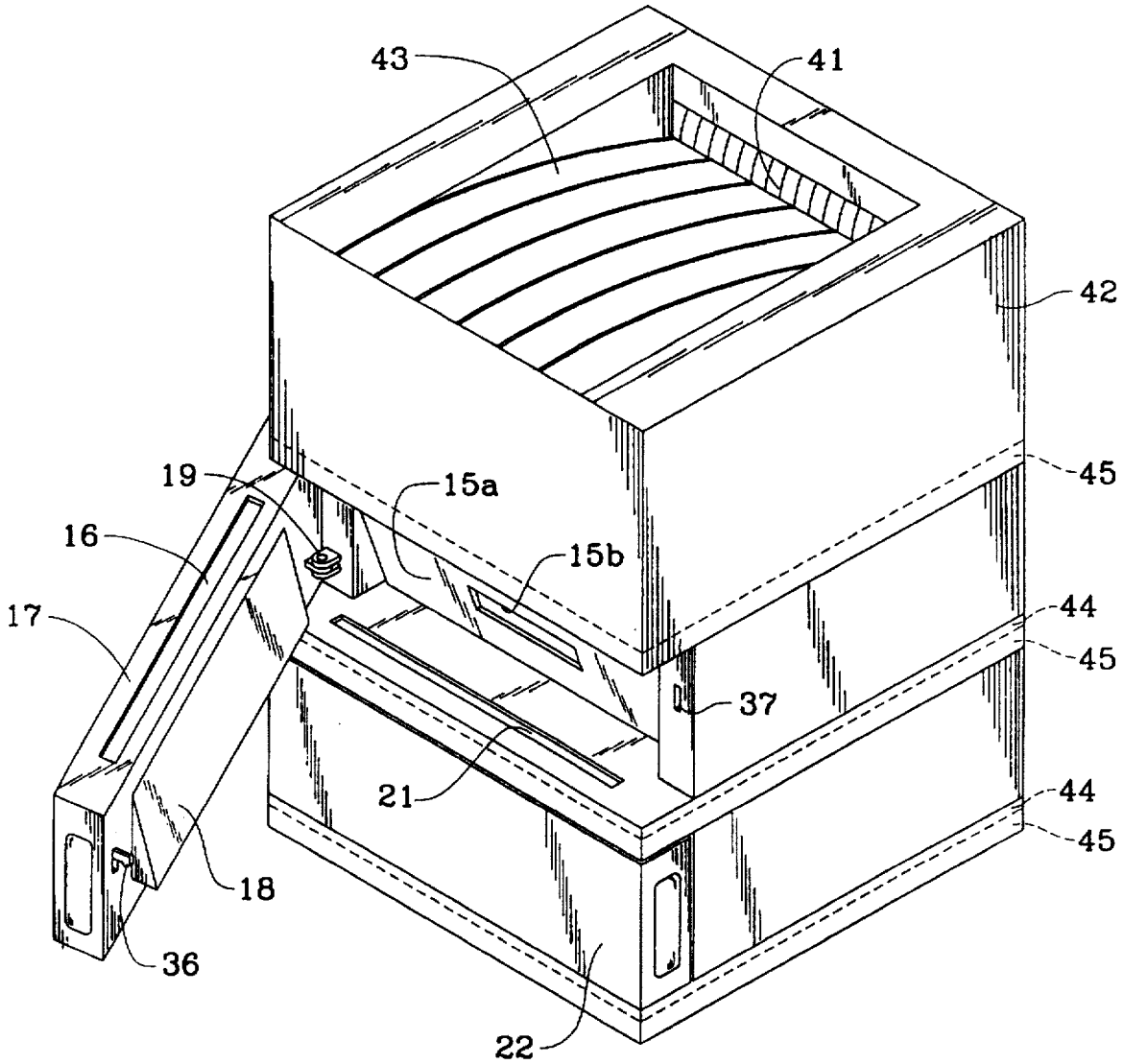
FIG. 4 is a perspective view of a printer, constructed in accordance with the present invention, and showing a door, with a media guide therein, for allowing media in the media tray below, to pass through and be fed in the media guide path schematically illustrated in FIG. 2 to the print engine.
Figure 5:
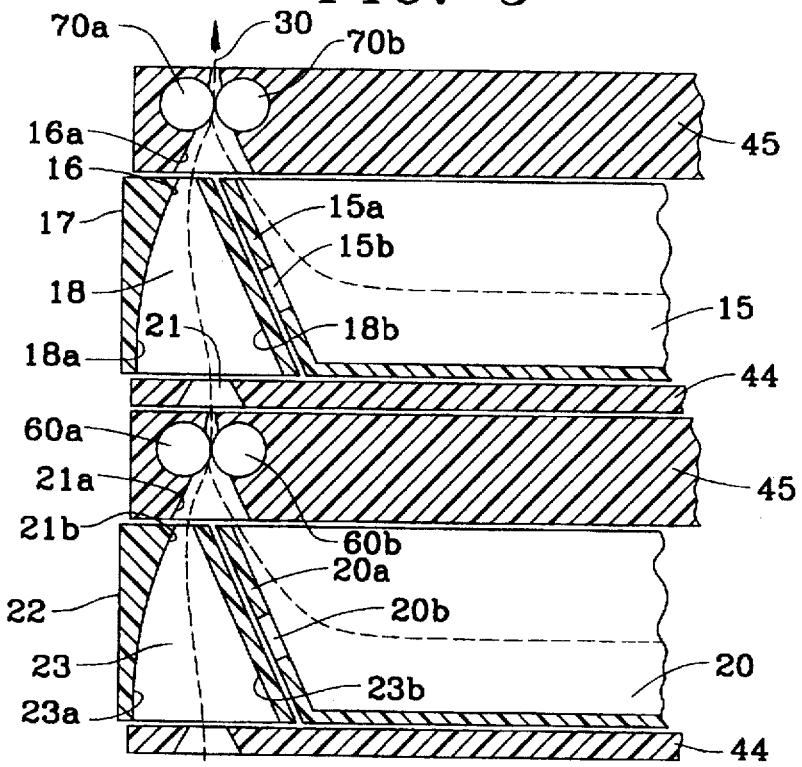
FIG. 5 is an enlarged, fragmentary side elevational view of the door contained media guide illustrated in FIG. 4.

In accordance with the invention separate media guide means are provided in lieu of the integral tray media guide means of the prior art, to permit media bypass of superimposed trays. As will be explained in more detail hereinafter, the media guide means are operative in association with each of the doors 17, 22 & 27 shown in FIGS. 1 & 2. To this end, and as shown in FIGS. 4 & 5, each of the trays, in the illustrated instance trays 15 and 20, includes a forward, upstanding wall portion 15*a*, 20*a*, with finger-hole slots 15*b*, 20*b* therein to facilitate tray removal by an operator-user. As shown, the trays are mounted for sliding relation relative to either racks 44 which form part of the frame 45 of the printer 10, or when part of a stackable, modular, media feed option, the racks 44 and frame 45 form part of each of the modular, stackable feed options. In either event, the racks are dimensioned to receive the trays, act as supports for the trays, and permit entrance and egress of the trays to and from the printer 10.

As shown, each of the doors, for example the doors 17 and 22 shown in section in FIG. 5, includes a guide chute 18, 23 respectively, comprising converging interior wall portions 18*a*, 18*b* and 23*a*, 23*b* respectively. As displayed, the media guide chute 18 associated with the door 17 terminates in a slot 16 which mates with a converging slot extension 16*a* in part of the frame 45, and which houses the drive or pinch rollers 70*a*, 70*b* to urge media in the media guide path 30. In a like manner, the slot 21, underlying and aligned with the chute 18, is in the rack 44 associated with the tray 15. The slot 21, in a similar manner is aligned with a slot 21*a* also carrying drive or pinch rollers 60*a*, 60*b*, and aligned with the slot 21*b* formed by the converging sidewalls 23*a*, 23*b* of the chute 23. It should be noted that the slot 16*a* and 21*a* are sufficiently wide at their media entry points or mouths to embrace media entering from the bypass chutes 18 and 23 respectively, but also to permit media picked from the trays 15 and 20 to enter the slots 16*a*, 21*a*. By locating the media guide means on the interior of the door, it may be seen that a tray may be missing from a rack or racks and the guide or chute would still operate in the manner heretofore described.

In accordance with a feature of the invention, the doors confronting the trays are swingable outwardly and away from the front of the trays, in the present instance trays 15, 20 and 25. By swinging the door outwardly, maximum clearance and unimpeded access for facilitating tray ingress and egress with respect to the printer 10 is facilitated. To this end, the doors each are hingeably attached, as by a hinge 19 to the frame 45 of the printer 10 (for simplification, only the hinge associated with the upper door 17 is shown, but the doors 22 and 27 may have similarly functional hinges.) As shown, the hinge 19 is vertically disposed, that is connected, in the example of FIG. 4, so that the door 17 is swingable between a first closed position and a second open position about a hinge line substantially parallel to the path 30 of the media. To hold the doors in the closed or first position, spring biased latch means 36 are provided, remotely from the hinge 19, and adapted for entry into an aperture 37 in the frame of the printer 10 or the modular options. (The latch construction will be described in greater detail hereinafter with respect to FIGS. 10–12.)

Figure 6:
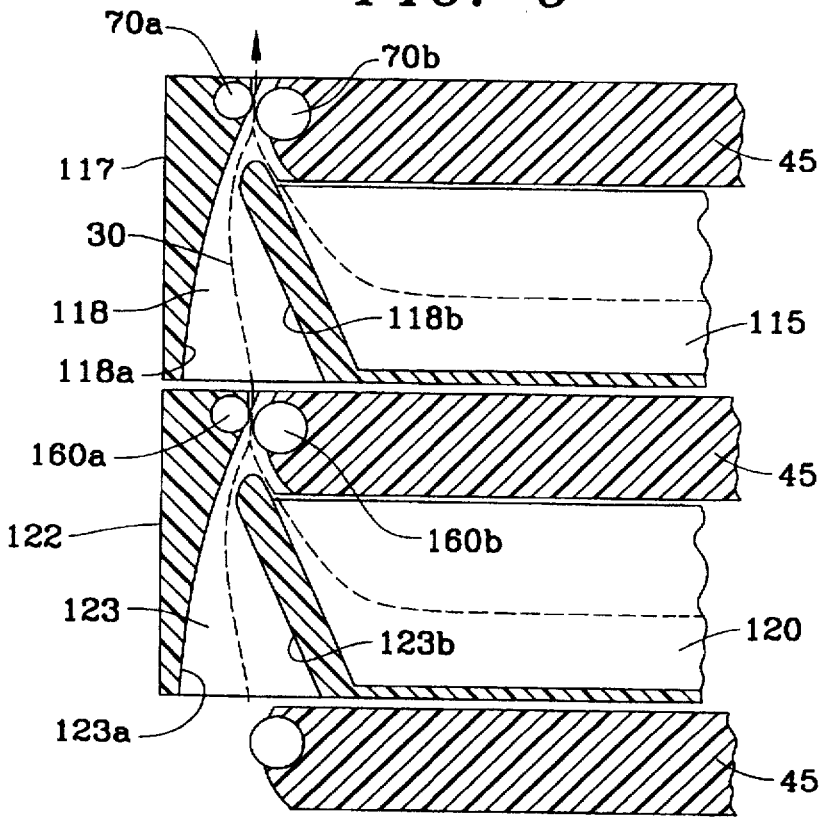
FIG. 6 is an enlarged, fragmentary side elevational view similar to FIG. 4 except that the door acts as ½ of the guide chute for media and the frontal portion of the tray acts as the other half, and that the door includes ½ of the pinch roll drive means for the media passing from a lower media tray into the printer print engine.

Referring now to FIG. 6, and in an alternate embodiment of the invention, doors 117, 122 are illustrated with associated media guide chutes 118 and 123 respectively, including converging interior walls 118*a*, 118*b* and 123*a* and 123*b* respectively. In this embodiment, the trays 115, 120 slidably engage parts of the frame 45 which act as racks for the media trays. In addition, in the embodiment of the invention shown in FIG. 6, each of the doors has a vertical extent which permits it to include the passive or idler rolls 70*a*, 160*a* of the pinch roll pairs 70*a*, 70*b*, and 160*a*, 160*b* respectively. The advantage of this configuration is that opening the door or doors confronting the media trays automatically effects uncoupling of the pinch rolls associated with the doors. This configuration is especially useful and helpful in clearing media jams between the media trays and the print engine.

Figure 7:
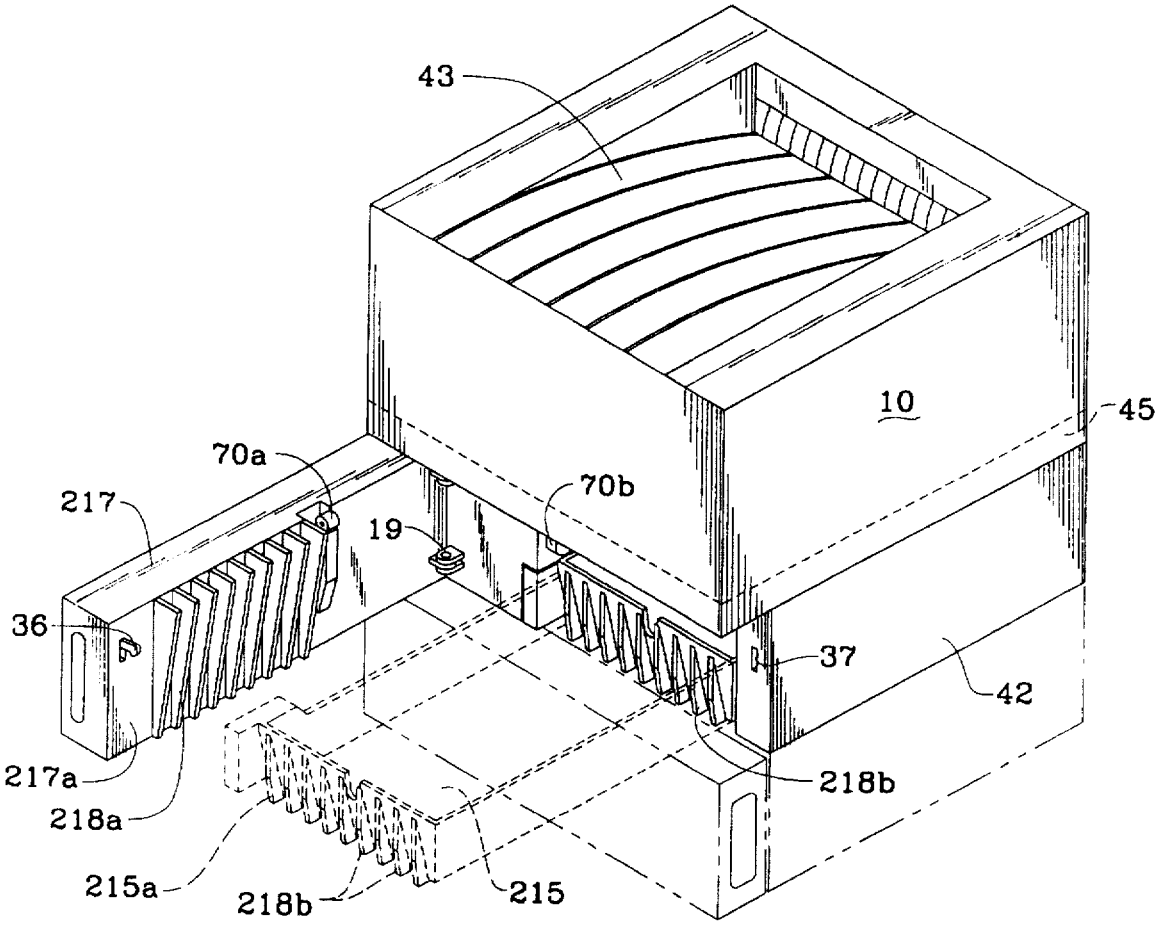
FIG. 7 is a perspective view of a printer constructed in accordance with the teachings of FIG. 6 and showing, by way of example only, the internals of a single, open door with the media tray withdrawn from the printer for receiving media such as paper.
Figure 8:
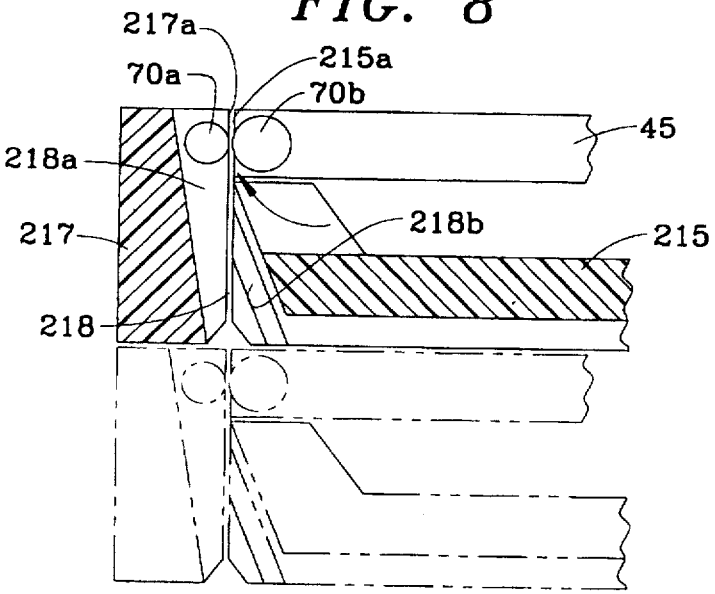
FIG. 8 is an enlarged, fragmentary sectional view of a portion of the door in place with the media tray of FIG. 7.

In still another embodiment of the present invention, the door and tray form separable halves of the media guide means or chute allowing media stored below each tray to be fed past the superimposed media tray, into the media path 30 and then into the print engine. To this end, and referring now to FIGS. 7 & 8, the printer 10 is shown with a single door 217 and tray 215, although it should be understood that there may be a number of similar doors and tray modules stacked below. In this configuration, and as best shown in FIG. 8, the media guide means or chute 218 is formed or defined, when the door 217 is in the first or closed position, by spaced apart coaction between the confronting portions of the door 217 and tray 215. As illustrated, the rear 217*a* of the door 217 and confronting forward portion 215*a*of the tray 215, when installed in the printer, contain upstanding, tapered ribs 218*a*, 218*b* defining a narrow converging media pass through slot or chute 218 therebetween. The ribs on both the door 217 and tray 215 are preferably tapered so as to be more narrow at their apex than their roots so as to minimize contact and friction with the media passing through the chute 218. Additionally, in a like manner to the embodiment illustrated in FIG. 6, and described heretofore, the door 217 may carry ½ of the pinch roll combination, i.e. idler roll 70*a*, the other or driver half 70*b* of the pinch rolls, would be carried, as before, by the frame 45 of the printer or the modular options.

Among the advantages of this configuration is that a separate media guide or chute does not have to be provided for media bypass. Furthermore, when the door is opened, i.e. moved into a second position such as shown in FIG. 7, the chute formed intermediate the door and tray and the coupling between the pinch rolls is broken, releasing any media jam in either the guides or the rolls. Moreover, the condition of the media is immediately observable and if any difficulties are observed, may be easily corrected by the operator-user.

In accordance with another feature of the invention, often it is desired by the operator-user to refill or insert new trays with different media sizes or even multiples of the same size. Moreover, often it is desirable to open all doors simultaneously to either clear paper jams or permit operator-user observation of the amount of paper left in a the trays etc., or to open only an individual door. This feature permits ganged operation for opening or closing the doors, while allowing for individual or separate operation of the doors. To this end, and referring now to FIGS. 9–12, a printer 90 is shown therein with multiple trays 93, 96, and 99 respectively, the trays being located in superimposed, overlapping relation to one another and supported within the printer casing 42*a* in a manner similar to that already described relative to FIGS. 1–8.

Figure 9:
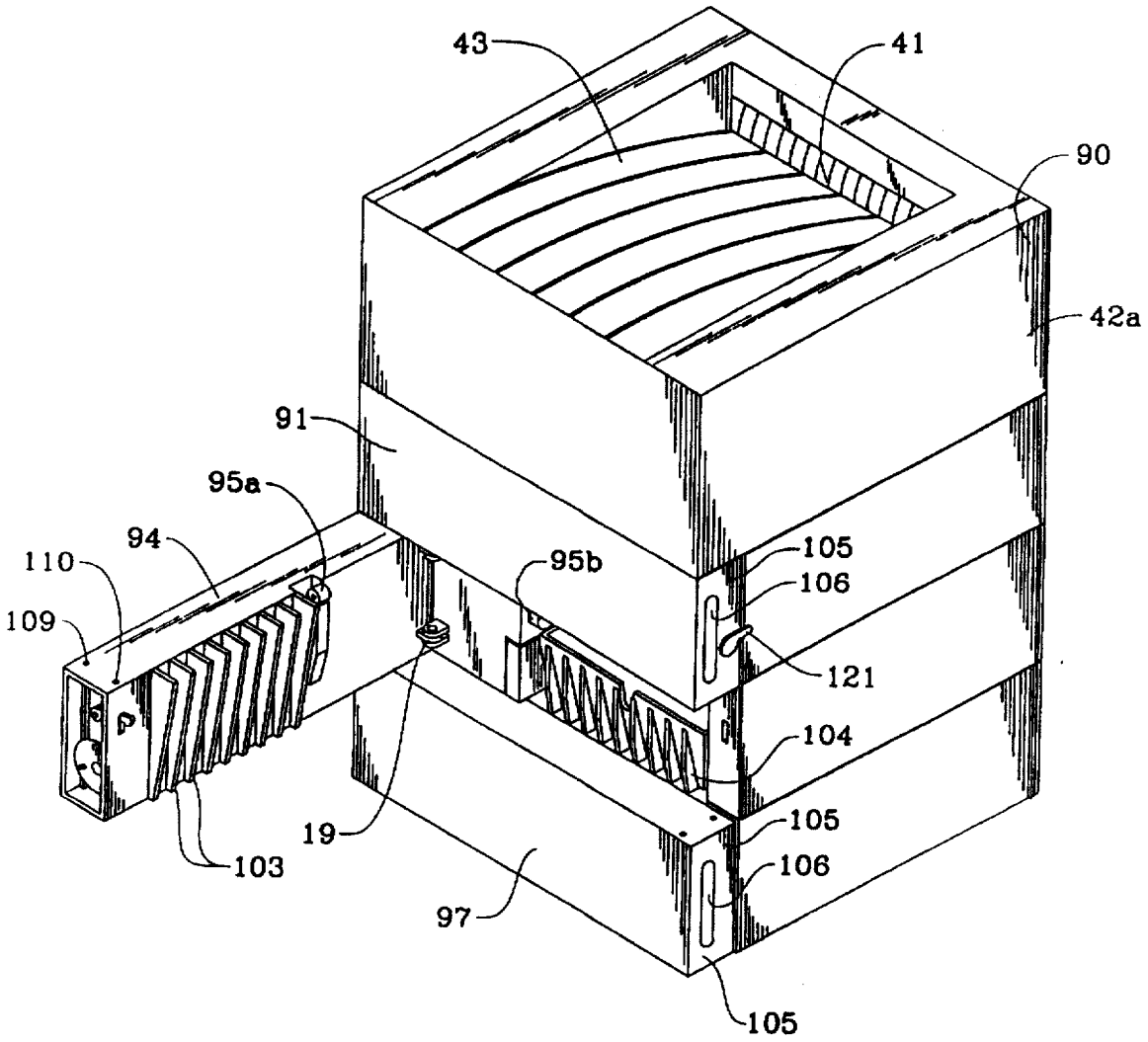
FIG. 9 shows an additional feature that can be implemented with either of the two configurations shown in FIGS. 5 or 6, and in which doors may be coupled so that each door may be opened either individually, or as a single, ganged unit.

In the embodiment illustrated in FIG. 9, the doors 91, 94, and 97 respectively confront trays 93, 96, and 99, the rear of the doors and the front of the trays forming the media guide means or chutes for permitting media bypass from the superimposed trays. In other words, when closed, the chute is formed ½ on the door and ½ on the tray. In this connection, each of the doors and trays contain upstanding, tapered ribs 103, 104 defining a narrow converging media pass through slot or chute therebetween. The ribs on both the doors 91, 94, 97, and the trays 93, 96, 99 ,are preferably tapered so as to be more narrow at their apex than their roots so as to minimize contact and friction with the media passing through the chute defined therebetween. Additionally, in a like manner to the embodiment illustrated in FIGS. 6 and 7, and described heretofore, the doors may carry ½ of the pinch roll combination, i.e. the idler rolls 92*a*, 95*a*, & 98*a* respectively, the other or driver half 92*b*, 95*b*, & 98*b* of the pinch rolls, would be carried, as before, by the frame 45 of the printer or the modular options.

Figure 10:
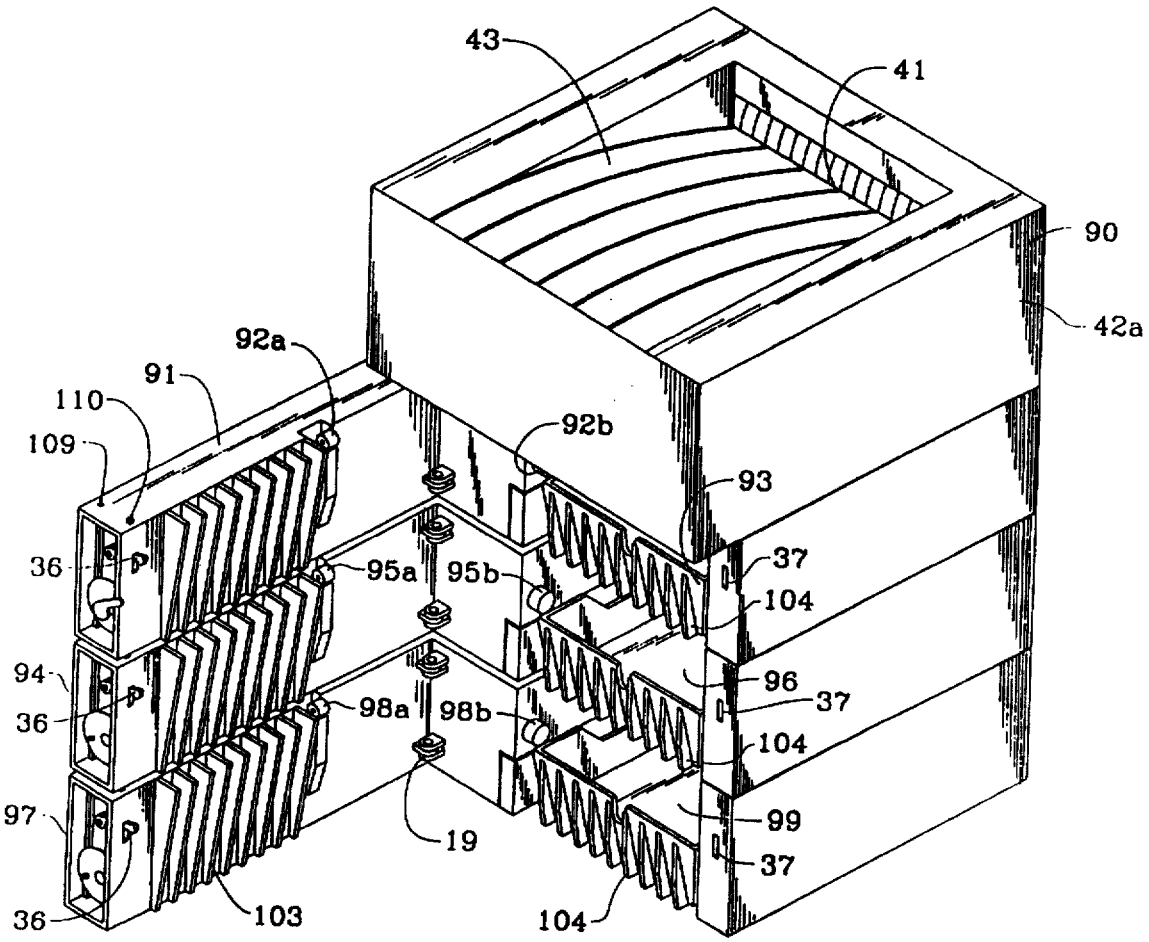
FIG. 10 is a perspective view of the printer shown in FIG. 9 with the doors in the ganged, open position.
Figure 11:
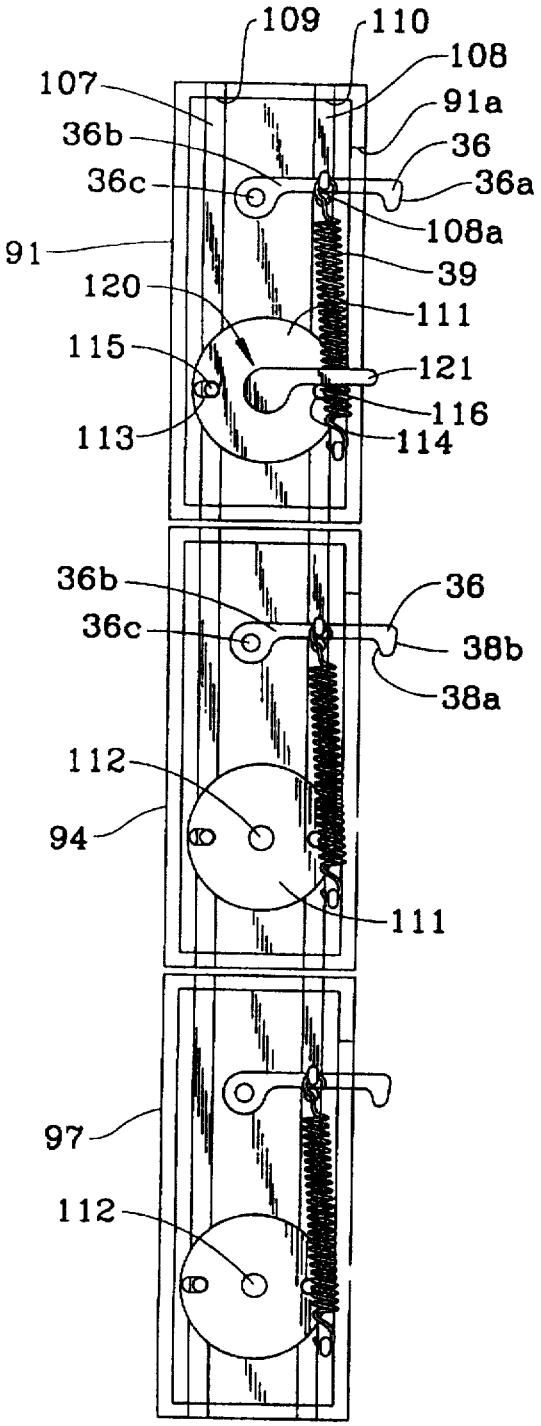
FIG. 11 is a fragmentary end view illustrating the doors in a condition for being opened individually.
Figure 12:
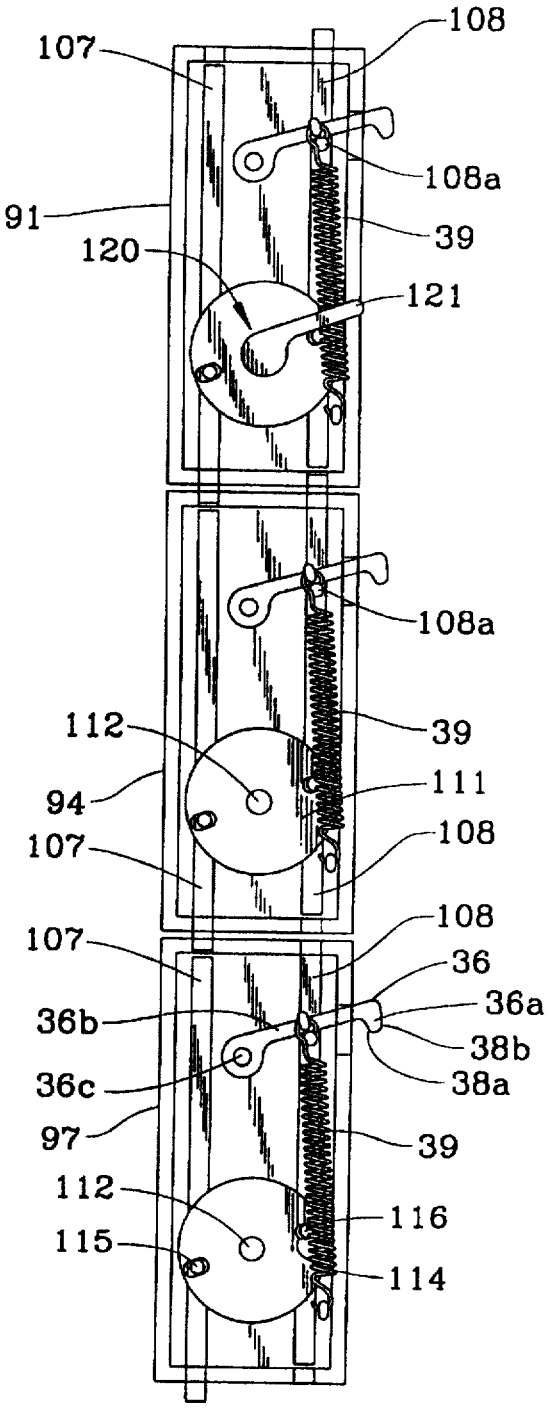
FIG. 12 is a fragmentary end view of the doors of FIG. 10 and with coupling means for ganging the doors so they would open as a unit or ganged.

As shown in FIG. 9, each of the doors (including the doors described heretofore relative to FIGS. 1–9) includes an end cap or cover 105 including finger-hole openings 106 to facilitate opening and closing individual ones of the doors, e.g. 91, 94 and 97, the cover 105 being removed from door 94 to better view the latch mechanism as discussed and described below relative to FIGS. 10–12.

In order to effect ganged opening and closing of the doors when such is desired by an operator-user, actuable coupling means for coupling each of the doors to its adjacent door, and thus to every other door, is provided and includes means for releasing the coupling means to permit opening of individual doors as desired. To this end, and referring now to FIG. 11 wherein the end caps or covers 105 have been removed from the ends of the doors 91, 94 and 97, each door is provided with spaced apart pairs of rod segments 107, 108 dimensioned for residing within the doors. The rod segments 107, 108 of each of the doors 91, 94 and 97 are aligned vertically with the rods of its adjacent door, when the doors are closed, through spaced apart, aligned apertures 109, 110 in the top and bottom of each door. Inasmuch as the segmented rods 107 and 108 are disposed within the doors, they are mounted for reciprocation between a first position with the rod segments disposed within the doors, and a second position with the rods in engagement with the adjacent door and in abutting aligned relation, end to end with the rod segments of adjacent doors so that the doors are coupled or ganged together for unitary operation.

To this end, each of the doors includes a coupling disk 111 mounted for rotation as by an axle 112 adjacent each of the door ends, and having a pair of oppositely disposed camming slots 113, 114 therein for engagement with nibs or projections 115, 116, respectively projecting from the segmented rods 107, 108. Connected to the uppermost disk 111 and axle 112 is an actuator 120 comprising a handle 121, which as shown in FIG. 10, projects through the end cap or cover 105 of upper door 91. When the doors 91, 94 and 97 are aligned, rotation of the actuator 120 and thus the coupling disk 111, causes the rods 107 and 108, due to the following of the nibs 115, 116, in the camming slots 113, 114, to pass through the apertures 109, 110, and into aligned abutting engagement with the rods below, causing a follower like movement of disks and rods in the doors 94 and 97 effectively coupling the doors together. Subsequent clockwise rotation of the handle 121 (which as discussed more fully hereinafter, as effected by biasing springs 39) causes the rod 107 to move upwardly, the rod 108 to move downwardly with a follower motion of the rods and coupling discs until the rods reside within their respective doors, uncoupling the doors from one another.

In order to permit selective opening and closing of the doors, each door is provided with a latch 36 having a lobe portion 36*a* with frontal 38*a* and rear 38*b* camming surfaces. The latch passing through a slot 91*a* in the door frame. The frontal lobe portion 36*a* is connected to a shank portion 36*b* pivotally connected to a stub or projection 36*c* on the door. When the doors are opened and closed individually, and the camming surfaces 38*a* and 38*b* enter or leave the aperture, slot or hole 37 in the frame, the latch shank 36*b* operates against the bias of spring 39. When the doors are opened together or ganged, an actuator nib 108*a* on the rod 108 engages the latch shank portion 36*b* of each of the latches 36 and lifts the same for simultaneous latch release. Moreover, the biasing spring 39 acts against the counterclockwise rotation of the handle 121 and serves as restoring force for reinsertion of the rods 107 and 108 into the normal or home position within each of the doors, as well as the actuator handle 121.

Thus the present invention provides media pass through configuration which avoids the inherent difficulties of the prior art. Moreover, the media pass through configuration of the present invention facilitates guidance of media from underlying media holding trays, while permitting ease of loading and unloading the same and clearing of incidental media jams in the media feed side of the print engine in the printer.

Although the invention has been described with certain degree of particularity, it should be recognized that elements thereof may be altered by person(s) skilled in the art with out departing from the spirit and scope of the invention as hereinafter set forth in the following claims.

What is claimed is:

1. A media pass through configuration for printers in which media is fed from removable media tray, through media path to print engine, said configuration comprising:

at least one media carrying, removable tray configured for placement beneath said print engine, a rack forming part of a frame and dimensioned for receiving said tray, a door, hinge and latch combination, said hinge connected intermediate said door and frame so that said door opens in a plane substantially that of the plane occupied by said tray beneath said print engine, and outwardly and away from the front of said tray, said latch being positioned remotely from said hinge for movably attaching said door to said printer in position confronting said tray, when said door is in closed or first position, and open for facilitating tray removal when said door is in an open or second position;

and media guide means on the interior of said door for guiding different media in front of said tray, into said media guide path and to said print engine, said media guide means comprising a chute having spaced guide surfaces for guiding said media in the absence of said tray.

2. A media pass through configuration for printers in which media is fed from removable media tray, through media path to print engine, said configuration comprising:

at least one media carrying, removable tray configured for placement beneath said print engine, a rack forming part of a frame and dimensioned for receiving said tray, a doors hinge and latch combination, said hinge connected intermediate said door and frame so that said door opens in a place substantially that of the plane occupied by said tray beneath said print engine, and outwardly and away from the front of said tray, said latch being positioned remotely from said hinge for movably attaching said door to said printer in position confronting said tray, when said door is in closed or first position, and open for facilitating tray removal when said door is in an open or second position;

and media guide means on the interior of said door for guiding different media in front of said tray, into said media guide path and to said print engine, said media guide means including converging interior walls for urging media therethrough in a predetermined path, said converging interior walls comprising a first portion thereof on said door and a second portion thereof formed on the portion of said tray confronting the interior of said door, a pair of pinch rolls, one of said pair of pinch rolls mounted on the door and confronting, when said door is closed, the other of said pair of pinch rolls mounted on said frame, said pinch rolls lying in the media path, in engagement with one another, when said door is closed, and confronting upstanding ribs on said first and said second portions of said chute.

3. A media pass through configuration for printers in which media is fed from removable media tray, through media path to print engine, said configuration comprising:

a plurality of media carrying, removable trays configured for placement beneath said print engine in superimposed, overlapping relation, a plurality of racks forming part of a frame and dimensioned for receiving one of said trays, at least some combinations of a door, hinge and latch, each said combination comprising a door confronting a different one of said trays when closed, said hinge being connected intermediate said door and frame so that said door opens in a place substantially that of the plane of a said tray which said door confronts when closed, and outwardly and away from the front of said tray, said latch being positioned remotely from said hinge for movably attaching said door to said printer in position confronting said tray, when said door is in closed or first position, and open for facilitating tray removal when said door is in an open or second position;

media guide means on the interior of said doors for guiding different media in front of said tray, into said media guide path and to said print engine, actuable coupling means for coupling each of said doors to every other door when desired for ganged opening of said doors, and means for releasing said coupling means to permit opening of individual doors when desired.

4. A media pass through configuration for printers in accordance with claim 3, wherein said coupling means comprises a rod segment disposed for reciprocation in each of said doors, between a first position with said rod segment of each door within said door, and a second position with said rod segment being disposed in engagement with an adjacent door; each of said rod segments being aligned, when said doors are closed, and means for camming said rod segments to effect engagement of a rod segment in one door also into engagement with an adjacent door whereby, when actuated, said doors are ganged for opening and closing, and when not actuated, the doors may be individually opened.

5. A media pass through configuration for printers in accordance with claim 4, including confronting, upstanding ribs on said first and second portions of said chute, said ribs being tapered to terminal end portions to minimize frictional contact with media passing therethrough.

6. A media pass through configuration for printers in which media is fed from a removable media tray, through a media path to a print engine, said configuration comprising:

a plurality of medium carrying removable trays in superimposed, overlapping relation and configured for placement beneath said print engine in one of a plurality of racks within said printer dimensioned for receipt of said trays, a plurality of laterally extending doors, each confronting a different one of said trays when closed, each said door having a hinge connected to each said door and one of said racks and disposed so that each said door is swingable between a first closed position and a second open position about a hinge line substantially parallel to said print media path; and a latch configured for holding said door in said closed second position confronting the said rack for holding said tray confronted by said door, media guide means on the interior of said doors for guiding different media in front of said tray, into said media guide path and to said print engine, said media guide means on said doors comprising a chute having converting interior walls therein for urging media therethrough in a predetermined path, actuable coupling means for coupling each of said doors to every other door when desired for ganged opening of said doors, and means for releasing said coupling means to permit opening of individual doors when desired.

7. A media pass through configuration for printers in accordance with claim 6, wherein said coupling means comprises a rod segment disposed for reciprocation in each of said doors, between a first position with said rod segment of each door within said door, and a second position with said rod segment being disposed in engagement with an adjacent door; each of said rod segments being aligned, when said doors are closed, and means for camming said rod segments to effect engagement of a rod segment in one door also into engagement with an adjacent door whereby, when actuated, said doors are ganged for opening and closing, and when not actuated, the doors may be individually opened.

8. A media pass through configuration for printers in accordance with claim 7 wherein said converging interior walls of said chute comprises a first portion thereof on said door and a second portion of said chute formed on the portion of said tray confronting the interior of said door.

9. A media pass through configuration for printers in accordance with claim 8 including a plurality of upstanding ribs on both the tray and confronting portion of the chute on said door defining said chute.

10. A media pass through configuration for printers in accordance with claim 8 including one of a pair of pinch rolls mounted on the door and confronting, when said door is closed, the other of said pair of pinch rolls mounted on the frame of said printer, said pinch rolls lying in the media path, in engagement with one another, when said door is closed.

11. A media pass through configuration for printers in accordance with claim 10 including confronting upstanding ribs on said first and second portions of said chute.

12. A media pass through configuration for printers in accordance with claim 11 wherein said ribs are tapered to terminal end portions to minimize frictional contact with media passing therethrough.

* * * * *